United States Patent [19]

Dal Monte

[11] Patent Number: 4,489,936

[45] Date of Patent: Dec. 25, 1984

[54] GYMNASTIC IMPLEMENT

[76] Inventor: Antonio Dal Monte, Piazza Apollodoro 26, Rome, Italy, 00196

[21] Appl. No.: 455,853

[22] Filed: Jan. 5, 1983

[30] Foreign Application Priority Data

Jan. 8, 1982 [IT] Italy ..... 47523 A/82

[51] Int. Cl.[3] ..... A63B 21/00

[52] U.S. Cl. ..... 272/120; 272/134; 272/143; 272/144

[58] Field of Search ..... 272/144, 93, 72, 67, 272/134, 126, 120; 280/47.3 R, 47.2, 11, 32.6, 47.37 C

[56] References Cited

U.S. PATENT DOCUMENTS 248,121 10/1881 Tuttle ..... 272/120
3,446,503 5/1969 Lauston ..... 272/120

FOREIGN PATENT DOCUMENTS 1039676 5/1953 France ..... 280/32.6

*Primary Examiner*—Richard J. Apley
*Assistant Examiner*—William R. Browne
*Attorney, Agent, or Firm*—Dennison, Meserole, Pollack & Scheiner

[57] ABSTRACT

The gymnastic implement is so conformed to train all the body's muscles, the resistance to the muscular action being represented by the user's weight. The implement has a board of suitable length for receiving the user's body in extended position and a frame member otherwise associable to said board and forming in its whole a lever system. The frame member has a first pair of parallel rods lying on a common plane, a second pair of parallel rods also lying on a common plane but inclined relative to the plane of said first pair of rods and elements interconnecting the rods of said first and second pairs transversely arranged relative to said board and forming the fulcrum and resistance of said lever system depending on the desired training to be carried out by the user.

13 Claims, 12 Drawing Figures

7
1
9
10
6
1
6
7
9
6
1
7
10
9

6
7
9

6
7
9
1
6
7
9

6
7
9
1

GYMNASTIC IMPLEMENT

The invention relates to a gymnastic implement so conformed to train all the body's muscles, the resistance to the muscular action being represented by the same user's weight.

Several gymnastic implements are at present known but all are designated to train each only specific body's muscles so that, for training all the muscles, a plurality of different implements is required with the obvious consequent drawbacks such as, for example, costs and necessity to have available plenty of room.

The invention as claimed is intended to remove these drawbacks since it solves the problem of how to train all the body muscles by means of a single gymnastic implement having dimensions extremely reduced.

The gymnastic implement, according to the invention, is essentially characterised in that it comprises a board or body support platform of suitable length for receiving the user's body in extended position and a frame member otherwise associable to said board and forming in its whole a lever system.

More particularly, such a frame member comprises a first pair of parallel rods lying on a common plane, a second pair of parallel rods also lying on a common plane but inclined relative to the plane of said first pair of rods and elements interconnecting the rods of said first and second pairs transversely arranged relative to said board and forming the fulcrum and resistance of said lever system depending on the desired training to be carried out by the user.

The invention is described in detail below with reference to drawings which illustrate only one specific embodiment, in which.

Figure 1:
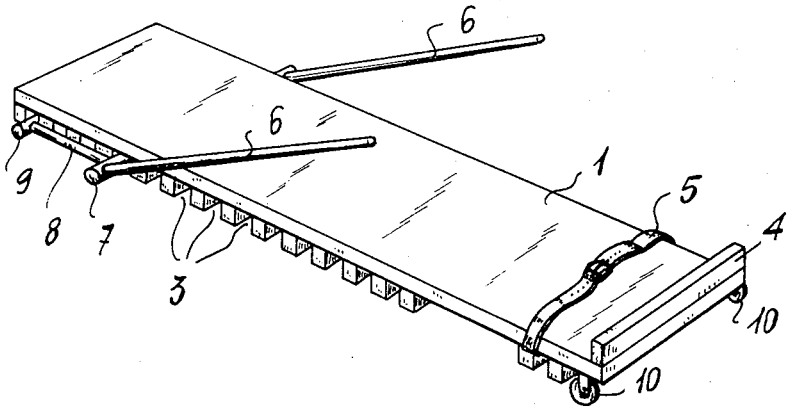
FIG. 1 is a perspective view of a gymnastic implement in accordance with the invention.
Figure 2:
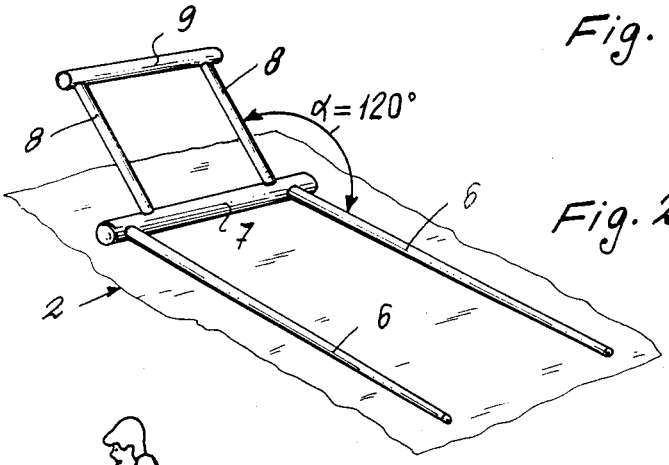
FIG. 2 is a perspective view of the frame member only.

Referring to FIGS. 1 and 2, the implement according to the invention comprises a board 1 and a frame member, generally shown at 2 in FIG. 2, constituting a lever system as a whole.

On its bottom surface, said board 1 has a series of transverse seats 3 and, on its upper surface, a foot rest 4 and retaining belts 5.

The frame element 2 comprises a first pair of parallel rods 6 interconnected by a transverse rod 7 of larger width than that of the board 1. A second pair of parallel rods 8 branch off from said rod 7 and have the ends thereof interconnected by a further transverse rod 9. The planes containing said rods 6 and 8 intersect at an angle $\alpha$, conveniently an angle of 130°, and a pair of idle rollers 10 is provided on the end portion of the board 1 on the side of said foot rest 4.

The gymnastic implement of the invention is basically based on the application on said lever system of tractions or pushes so as to accomplish contrasting movements, in which the opposite reaction to the drive action is constituted by the user's weight.

Figure 3:
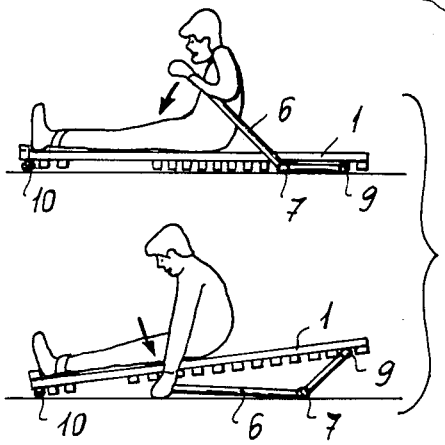
FIGS. 3 to 12 are views showing some of the possible exercises that can be performed by using the implement shown in FIG. 1.
Figure 4:
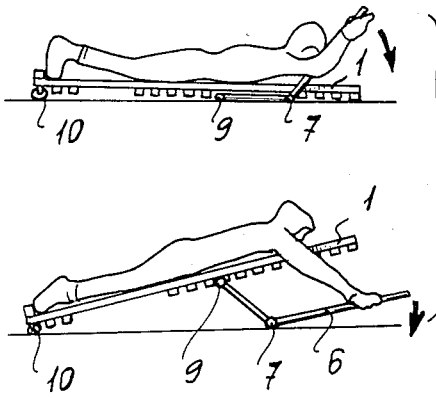
Figure 5:
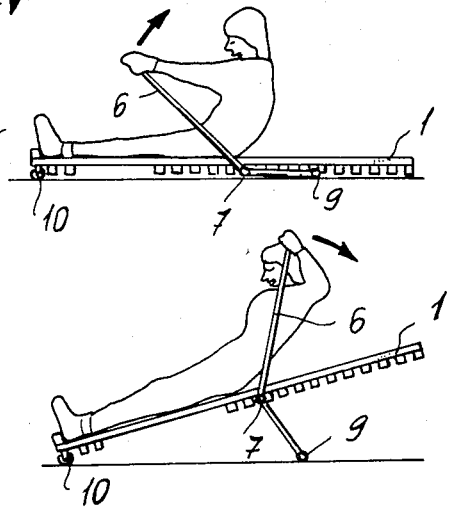
Figure 6:
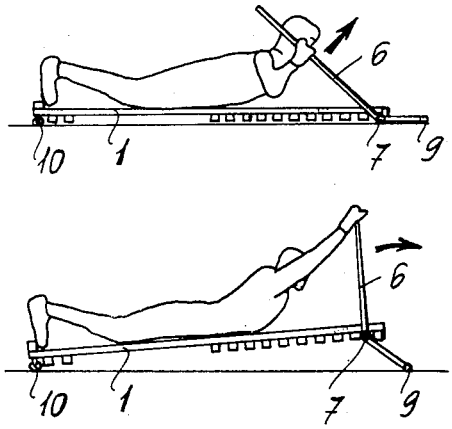
Figures 7, 8, 9:
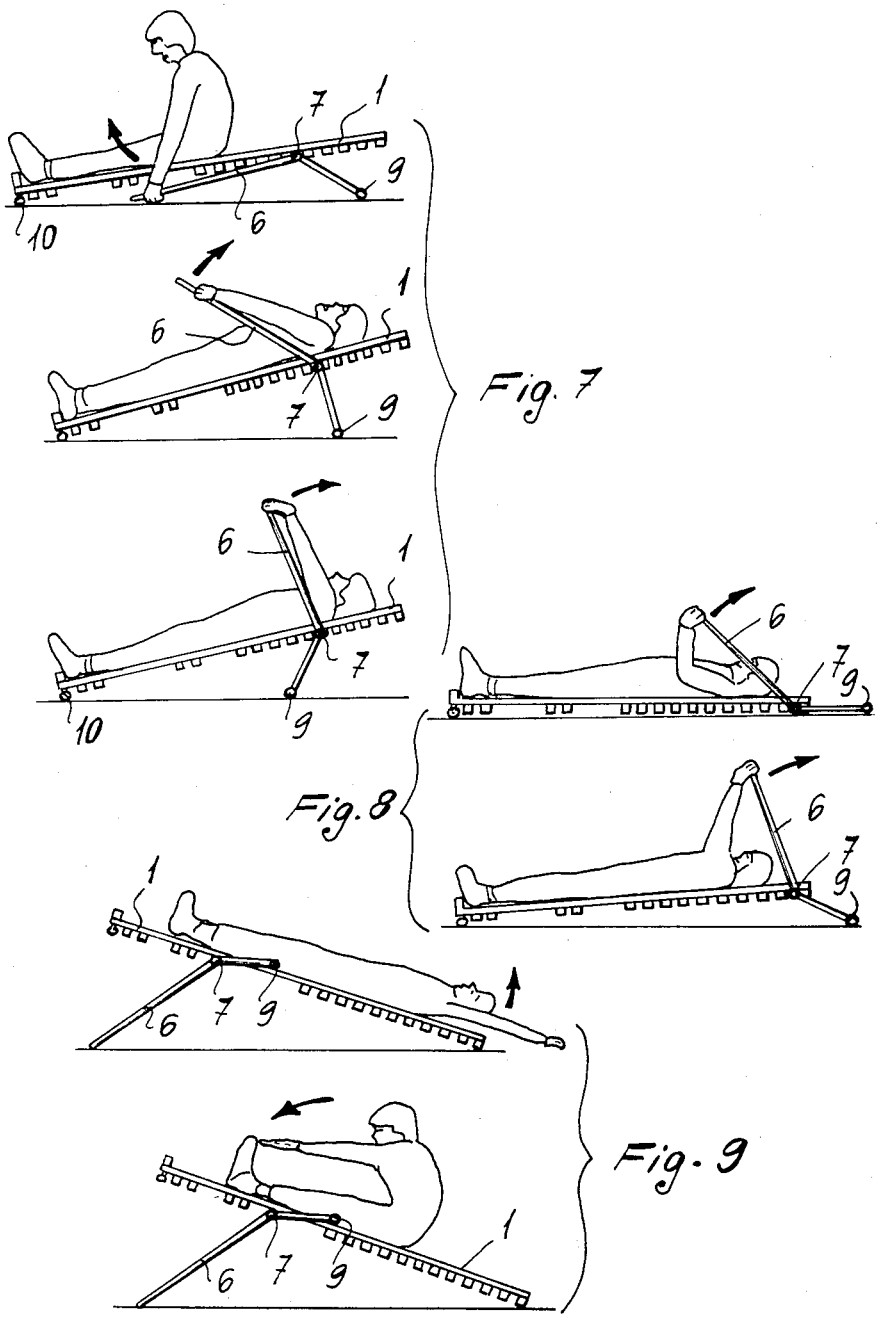
Figure 10:
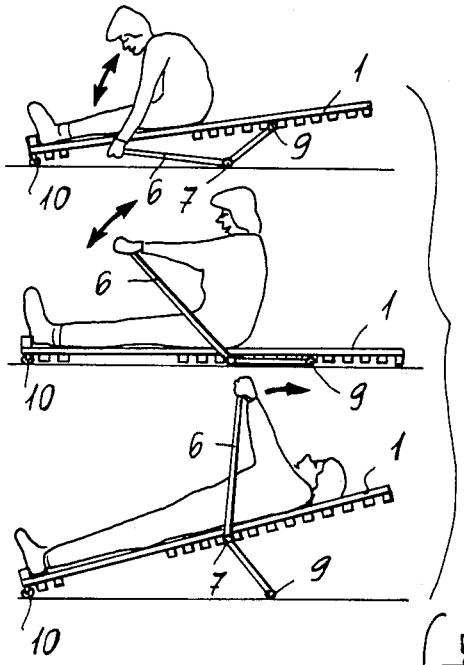
Figure 11:
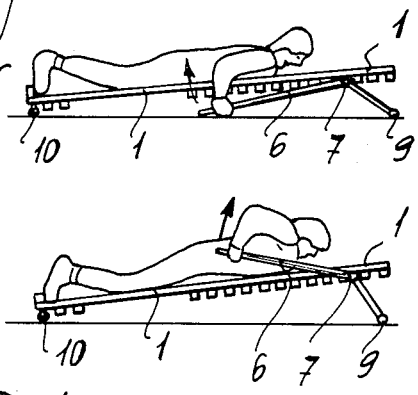
Figure 12:
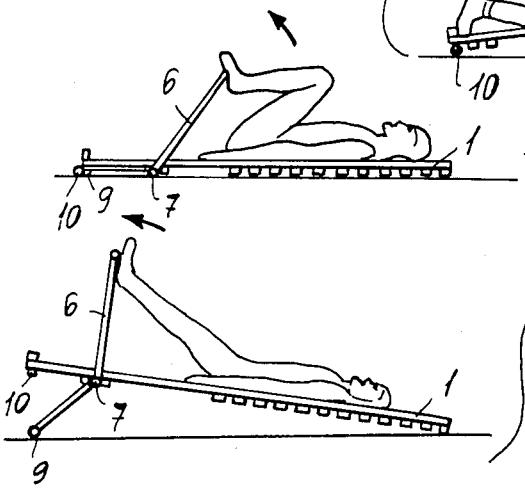

FIGS. 3 to 9 show some possible exercises that can be carried out by implement according to the invention, namely:

FIG. 3 shows the extension of the upper limbs from top to bottom with intervention of extensor muscles for the upper limb, pectoral or breast muscles and shoulder muscles;

FIG. 4 shows the rear-to-front rotation of the extended upper limbs, with the concern of deltoid, dorsal and pectoral or breast muscles;

FIG. 5 shows the front-to-rear flexion of the upper limbs with a movement similar to that of a rower with concern of the brachial biceps muscle and other flexor muscles of forearm on arm, dorsal muscles, shoulder muscles, trunk extensor, etc;

FIG. 6 shows the upward and forward thrust of the upper limbs at prone position; and FIG. 7 shows the downward extension of the upper limbs and front flexion of the trunk with final rearward bust extension with concern of extensor muscles of the upper limbs and simultaneous action of the muscles for the shoulder, front side of the thorax, abdominal muscles and rear side of the trunk (dorsal muscles, paravertebral muscles).

In FIGS. 8 to 12 further positions of the frame member 2 are shown for carrying out other exercises for training different muscular units.

By shifting the position of the hands along the rods 6 the force/resistance ratio of the lever system can obviously changed in order to increase or decrease the muscular strength required.

In a modified embodiment, not shown, rods 6 and 8 can be connected to the transverse rod 7 by means of any conventional device suitable to change the value of angle $\alpha$ and/or a device for changing the divergency of said rods 6 and 8, as desired.

What is claimed is:

1. In gymnastic apparatus for body training through user manipulation, a body support platform and a platform supporting and manipulating frame, said frame including first frame means for support and manipulation of said platform and second frame means for support and manipulation of said platform in cooperation with said first frame means, an intermediate portion between and interconnecting said first and second frame means, said first frame means including first platform engageable means for engaging said platform, said intermediate portion including second platform engageable means for engaging said platform, and mounting means on said support platform for selectively receiving said first and second platform engageable means to vary the manipulative relationship between the frame and platform, each of said platform engageable means selectively defining a fulcrum for pivotal manipulation of said frame and said platform upon physical engagement with and manipulation of said second frame means.

2. In the gymnastic apparatus of claim 1, said mounting means comprising a plurality of mounts at selected positions longitudinally spaced along said platform for selectively varying the position of engagement of either of said platform engageable means with the platform.

3. In the gymnastic apparatus of claim 2, said first frame means comprising a first pair of laterally spaced parallel rods lying in a common plane, said second frame means comprising a second pair of laterally spaced parallel rods lying in a common plane, said first and second pairs of parallel rods being oppositely directed from said intermediate portion.

4. In the gymnastic apparatus of claim 3, the rods in said first and second pairs of rods having generally transversely aligned inner ends, said intermediate portion comprising a transverse rod engaged between and interconnecting said inner ends, said transverse rod defining said second platform engageable means.

5. In the gymnastic apparatus of claim 4, said plurality of mounts comprising downwardly directed rod receiving seats.

6. In the gymnastic apparatus of claim 5, said first platform engageable means comprising rod means for selective engagement with said mounting means rigid with and laterally between the parallel rods of said first pair of rods outward of said intermediate portion.

7. In gymnastic apparatus for body training through user manipulation, an elongate body support platform, a frame for supporting said platform on and relative to a support surface, said frame including multiple portions selectively engageable with said platform, and mounting means on said platform at selected positions therealong for selectively receiving said platform engageable portions and permitting said platform engageable portions to be selectively positioned in the mounting means along said platform so as to permit various exercises to be performed on the apparatus.

8. In the gymnastic apparatus of claim 7, said frame comprising first and second pairs of rods, each pair of rods comprising two laterally spaced parallel rods in a common plane, the rods of each pair of rods having inner ends and outer ends, the inner ends of all of the rods being generally transversely aligned, said portions of said frame selectively engageable with said platform comprising first transverse rod means extending between and interconnecting the inner ends of the rods of both pair of rods, and second transverse rod means engaged with the outer ends of the rods of one of said pair of rods.

9. In the gymnastic apparatus of claim 7, the planes of said first and second pairs of parallel rods being inclined relative to each other.

10. In the gymnastic apparatus of claim 9, said mounting means comprising a plurality of downwardly directed seats along said platform, said seats being configured for selective reception of said first and second transverse rod means.

11. In the gymnastic apparatus of claim 7, said mounting means comprising a plurality of downwardly directed seats along said platform.

12. In gymnastic apparatus, a user supporting elongate board and a user manipulating frame; said frame comprising a first pair of laterally spaced elongate parallel rods lying in a first plane, a second pair of laterally spaced elongate parallel rods lying in a second plane inclined relative to the first plane, said first and second pairs of rods having generally transversely aligned inner ends and remote outer ends, transverse rod means interconnecting the inner ends of the first pair of rods with the inner ends of the second pair of rods; said user supporting board including a lower surface with a series of receiving seats at spaced positions along the length thereof, said seats selectively receiving said transverse rod means for a varying of the positional engagement of the frame with the board whereby a variety of different exercises may be performed on the apparatus.

13. In the gymnastic apparatus of claim 12, an additional transverse rod means on the outer ends of said first pair of parallel rods, said additional transverse rod means being selectively and variably receivable within said seats.

* * * * *